US005726637A

United States Patent [19]

Miyahara et al.

[11] Patent Number: 5,726,637

[45] Date of Patent: Mar. 10, 1998

[54] ALARM AND SAFEGUARD SYSTEM

[75] Inventors: Keisuke Miyahara, Tokorozawa; Yohichi Matsuda, Tokyo, both of Japan

[73] Assignee: Teac Corporation, Tokyo, Japan

[21] Appl. No.: 586,289

[22] Filed: Jan. 16, 1996

[30] Foreign Application Priority Data

Jan. 27, 1995 [JP] Japan ..... 7-11719
Nov. 24, 1995 [JP] Japan ..... 7-306290

[51] Int. Cl.[6] ..... G08B 17/06; G08B 21/00

[52] U.S. Cl. ..... 340/690; 52/1; 52/750; 169/23; 169/61; 340/515; 340/516; 340/540; 340/587

[58] Field of Search ..... 340/690, 587, 340/584, 515, 516, 540, 691; 169/61, 23; 52/1, 750; 180/274

[56] References Cited

U.S. PATENT DOCUMENTS 4,518,952 5/1985 Tanaka et al. ..... 340/515
4,595,914 6/1986 Siegel ..... 340/515
5,172,099 12/1992 Glaser ..... 340/587
5,544,716 8/1996 White ..... 180/274

FOREIGN PATENT DOCUMENTS 59-48098 11/1984 Japan .

*Primary Examiner*—Glenn Swann
*Attorney, Agent, or Firm*—Michael N. Meller

[57] ABSTRACT

A set of first and second detecting units detects an emergency. First and second pseudo-emergency generating units generate a pseudo-emergency for the first and second detecting units. A driving unit alternately drives the first and second pseudo-emergency generating units. An abnormality detecting unit detects operation of the first and second detecting units detecting the pseudo-emergency from the first and second pseudo-emergency generating units, the abnormality detecting units performing a predetermined indication when thus-detected operation is abnormal. An emergency detection outputting unit, in an emergency, outputs an emergency detection signal in response to reception of emergency detection signals from both the first and second detecting units.

7 Claims, 12 Drawing Sheets

FF OUTPUT (SWITCHING PULSES)

MMV OUTPUT

OSCILLATOR OUTPUT

FIRST PIEZOELECTRIC SPEAKER OUTPUT

SECOND PIEZOELECTRIC SPEAKER OUTPUT

FIRST ACCELERATION SENSOR OUTPUT

SECOND ACCELERATION SENSOR OUTPUT

EARTHQUAKE OCCURRENCE

EARTHQUAKE DETECTION SIGNAL

ALARM AND SAFEGUARD SYSTEM

BACKGROUND OF THE INVENTION

1. Field of the Invention

The present invention relates to an emergency detection sensor system which detects an emergency and a safeguard system which protects a human body in an emergency.

2. Description of the Related Art

In an emergency such as a fire, an earthquake or the like, it is necessary to rapidly take safety measures. For this purpose, rapid and sure detection of an emergency is needed. Further, it is also necessary to surely protect human bodies in an emergency.

A security system has been used in a building or the like as safety measure in an emergency. Such a system is incorporated in a disaster preparedness system and works 24 hours. A person of a specialized company such as a security company periodically inspects places in which such disaster preparedness systems are provided for maintenance of the security system.

In a country or a region in which earthquakes frequently occur, earthquake disasters are well understood. Therefore, various safeguard goods are prepared and also safeguard mechanisms are provided in electrical products or the like. For example, supporting poles may be inserted between a ceiling and a piece of furniture such as a chest of drawers so as to prevent the piece of furniture from falling due to shaking in an earthquake. Also, a bag which contains emergency foods, drinking water, winter clothes and so forth may be prepared. Further, an oil heater and an electric heater have mechanisms which perform fire fighting or power supply disconnection in an earthquake of more than a predetermined value.

However, inspecting security systems requires considerable time and labor. Further, if a period between maintenance inspections is long, there is a possibility that a malfunction may occur in the security systems.

Further, in an earthquake having an energy large enough to destroy apartments and wooden houses, there may be no time for taking refuge. In particular, if an earthquake occurs when residents are sleeping or residents are very young or very old, taking refuge may be delayed in general. Therefore, residents may be buried under rubble of destroyed houses and thus be seriously hurt. In such a case, the above-described safeguard goods are not helpful.

It may be possible to provide houses having structures such that the houses are not destroyed when an earthquake of a large energy occurs or such that residents are protected even if the houses are destroyed. However, if such structures are applied, houses are very expensive and therefore it is not possible to apply such structures for all the houses.

SUMMARY OF THE INVENTION

The present invention has been made for solving the above-described problems and an object of the present invention is to provide an emergency detection sensor system which surely detects an emergency and a safeguard system which easily, inexpensively, and surely protects human bodies.

In order to achieve this object, an emergency detection sensor system according to the present invention comprises:

at least a set of first and second detecting means which detects an emergency;

first and second pseudo-emergency generating means which generate a pseudo-emergency for said first and second detecting means;

driving means which alternately drives said first and second pseudo-emergency generating means;

abnormality detecting means which detects an operation of said first and second detecting means detecting the pseudo-emergency from said first and second pseudo-emergency generating means, said abnormality detecting means performing a predetermined indication when thus-detected operation is abnormal; and emergency detection outputting means which, in an emergency, outputs an emergency detection signal in response to reception of emergency detection signals from both said first and second detecting means.

It is preferable that a predetermined indication is performed or predetermined emergency protecting means is driven by the emergency detection signal output by said emergency detection outputting means.

In this system, in a normal state, the pseudo-emergencies alternately generated by the first and second pseudo-emergency generating means are detected by the first and second detecting means. Thereby, a malfunction in the first or second detecting means can be recognized and therefore eliminated before an actual emergency occurs. Thereby, an actual emergency can be surely detected. In an actual emergency, the emergency detection outputting means detects the emergency detection signals simultaneously supplied by both the first and second detecting means and thus outputs the emergency detection signal. Thereby, the predetermined indication is performed or the predetermined emergency protecting means is driven.

A safeguard system according to the present invention comprises:

shaking detecting means which detects shaking of a predetermined intensity;

swelling means which swells to a predetermined size in response to a predetermined medium put thereinto, thereby blocking moving obstacles and producing a protective space; and medium supplying means which, in response to an shaking detection by said shaking detecting means, supplies the predetermined medium to said swelling means and thus causes said swelling means to swell.

Thereby, when shaking of the predetermined intensity occurs, the protective space is produced and thus a human body can be surely protected in the protective space. Further, it is possible to provide the safeguard system inexpensively because an arrangement of the safeguard system is simple. As a result, the safeguard system can be widely used.

It is preferable that said shaking detecting means comprises:

at least a set of first and second detecting means which detects an emergency;

first and second pseudo-emergency generating means which generate a pseudo-emergency for said first and second detecting means;

driving means which alternately drives said first and second pseudo-emergency generating means;

abnormality detecting means which detects operation of said first and second detecting means detecting the pseudo-emergency from said first and second pseudo-emergency generating means, said abnormality detecting means performing a predetermined indication when thus-detected operation is abnormal; and emergency detection outputting means which, in an emergency, outputs an emergency detection signal in response to reception of emergency detection signals from both said first and second detecting means.

Thereby, shaking in the emergency can be surely detected and thus a human body can be surely protected.

It is preferable that the safeguard system further comprises backflow checking means which is provided between said medium supplying means and said swelling means, and prevents the predetermined medium, being supplied to said swelling means, from flowing backward.

Thereby, it is possible to prevent the medium having been put into the swelling means from leaking therefrom, and thereby to maintain the protective space produced by the swelling means for a long time.

It is preferable that the safeguard system further comprises alarming means which produces an alarm by outputting a predetermined signal in response to the shaking detection by said shaking detecting means.

Thereby, a presence of the human body in the protective space is reported and rescue of the human body can be surely performed.

Other objects and further features of the present invention will become more apparent from the following detailed description when read in conjunction with the accompanying drawings.

DESCRIPTION OF PREFERRED EMBODIMENTS

Figure 1:
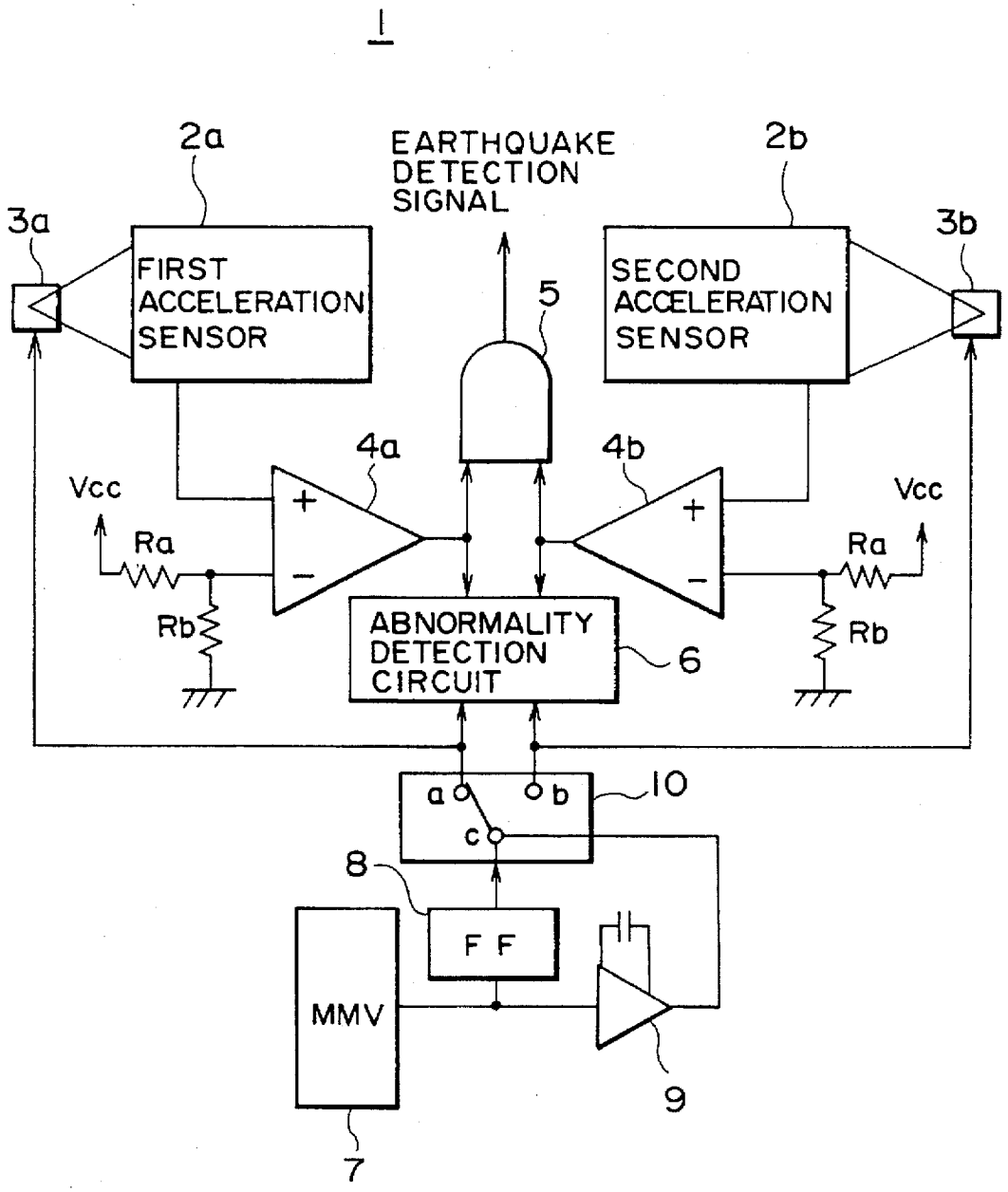
FIG. 1 shows a circuit diagram of a first embodiment of the present invention.

FIG. 1 shows an earthquake detection system 1 in the first embodiment of an emergency detection sensor system of the present invention. In the system 1, first and second acceleration sensors 2*a* and 2*b* act as first and second detecting means and are provided in a detection area. The first and second acceleration sensors 2*a* and 2*b* are provided with first and second piezoelectric speakers 3*a* and 3*b* which act as first and second pseudo-emergency generating means, respectively. Each of the first and second piezoelectric speakers 3*a* and 3*b* generates a pseudo-emergency in a respective one of the first and second acceleration sensors 2*a* and 2*b* by applying vibration to the respective one, and thus causes the respective one to detect the pseudo-emergency.

In the system 1, detection signals output by the first and second acceleration sensors 2*a* and 2*b* are input to non-inverting input terminals of first and second comparators 4*a* and 4*b*, respectively. A reference voltage which is set from a power source Vcc via resistors Ra and Rb is input to an inverting terminal of each of the comparators 4*a* and 4*b*. An output of each of the first and second comparators 4*a* and 4*b* is supplied to an AND gate circuit 5 acting as emergency detection outputting means and to an abnormality detection circuit 6 acting as abnormality detecting means.

In the system 1, an MMV (Monostable Multi-Vibrator) 7 is provided and an output of the MMV 7 is supplied to a FF (Flip-Flop circuit) 8 and an oscillator 9 which oscillates at a low frequency in an order of approximately 100 Hz. An oscillation output from the oscillator 9 is supplied to a 'c' (common) terminal of a switch circuit 10, and then, via an 'a' terminal and a 'b' terminal, is supplied to the first and second piezoelectric speakers 3*a*, 3*b*, respectively, and to the abnormality detection circuit 6. The switch circuit 10 is operated by the output of the FF 8 and thus the 'a' and 'b' terminals are alternately connected with the 'c' terminal periodically. The above-described MMV 7, FF 8 and oscillator 9 act as driving means.

Figure 2:
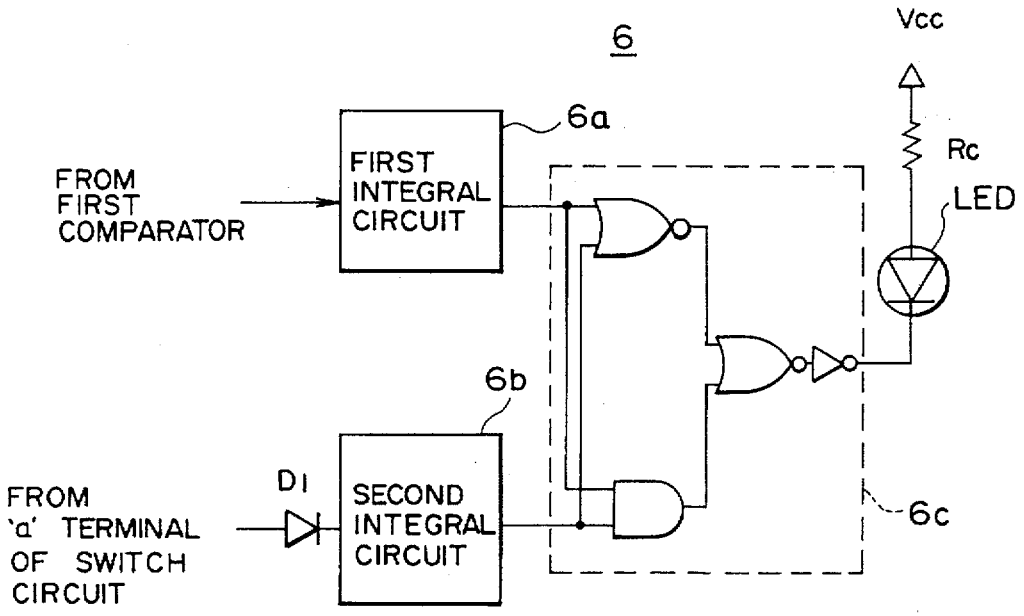
FIG. 2 shows a partial circuit diagram of an example of an abnormality detection circuit shown in FIG. 1.

FIG. 2 shows a circuit, for the first acceleration sensor 2*a*, in the abnormality detection circuit 6 shown in FIG. 1. An identical circuit for the second acceleration sensor 2*b* is also provided in the abnormality detection circuit 6.

In the circuit shown in FIG. 2, the output of the first comparator 4*a* is integrated by a first integral circuit (for example, including a CR circuit made of a resistor R and a capacitor C) 6*a* and then input to an input terminal of an inverted exclusive-OR gate circuit 6*c*. As shown in FIG. 2, the inverted exclusive-OR gate circuit 6*c* includes an exclusive-OR circuit and an inverter connected at an output of the exclusive-OR circuit.

The inverted exclusive-OR gate circuit 6*c* supplies a Low-level output when levels of the two inputs are different from one another. That is, the inverted exclusive-OR gate circuit 6*c* supplies the Low-level output when a level of one of the two inputs is a High level and a level of the other one of the two inputs is a Low level. The inverted exclusive-OR gate circuit 6*c* supplies a High-level output when levels of both the two inputs are the same level. That is, the inverted exclusive-OR gate circuit 6*c* supplies the High-level output when levels of both the two inputs are the High level. The inverted exclusive-OR gate circuit 6*c* also supplies the High-level output when levels of both the two inputs are the Low level.

An oscillation signal supplied from the switch circuit 10 (at the 'a' terminal) is rectified by the diode $D_1$, integrated by a second integral circuit (identical to the first integral circuit 6*a*) 6*b*, and then supplied to the other input terminal of the inverted exclusive-OR gate circuit 6*c*.

The inverted exclusive-OR gate circuit 6*c* has an open-collector logic circuit or another circuit having a function equivalent to the open-collector logic circuit, at an output portion thereof. An output terminal of the inverted exclusive-OR gate circuit 6*c* is connected with an LED (Light-Emitting Diode) at a cathode thereof, which LED is connected with the power source Vcc via a resistor Rc at an anode thereof. Thus, the LED is connected in a manner matching a forward direction of the LED. When the inverted exclusive-OR gate circuit 6c outputs a Low level, an electric current flows from the power source Vcc through the LED which thus emits light.

Figure 3A:
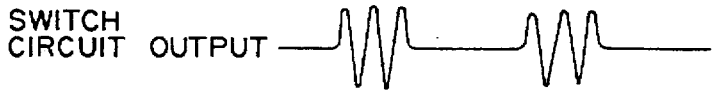
FIGS. 3A, 3B, 3C and 3D show waveforms of signals in the circuit shown in FIG. 2.
Figure 3B:
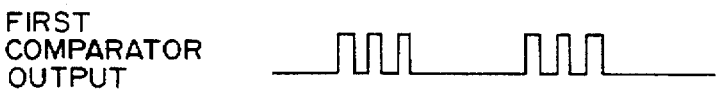
Figure 3C:
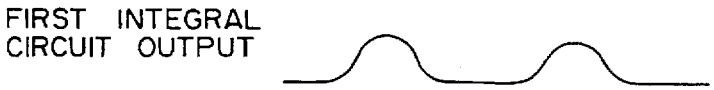
Figure 3D:
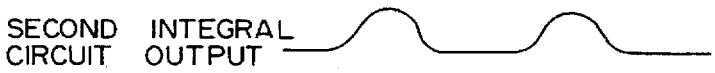

FIG. 3A shows a signal supplied to the diode $D_1$ from the switch circuit 10, FIG. 3B shows the output of the first comparator 4a, and FIGS. 3C and 3D show output signals of the first and second integral circuits 6a and 6b respectively.

In the circuit shown in FIG. 2, when the output at a High level shown in FIG. 3D of the second integral circuit 6b from the signal shown in FIG. 3A supplied from the 'a' terminal of the switch circuit 10 and also the output at the High level shown in FIG. 3C of the first integral circuit 6a from the output signal shown in FIG. 3B supplied from the first comparator 4a are simultaneously input to the inverted exclusive-OR gate circuit 6c, the inverted exclusive-OR gate circuit 6c outputs the High level. As a result, as shown in FIGS. 3C and 3D, the waveforms of the signals supplied to the inverted exclusive-OR gate circuit 6c are substantially identical to one another. Accordingly, the LED does not emit light.

However, if, for example, the first acceleration sensor 2a malfunctions and therefore the first comparator 4a does not output the High level shown in FIG. 3C, the inverted exclusive-OR gate circuit 6c outputs the Low level and therefore the LED emits light. Thus, the malfunction is indicated.

Figure 4A:
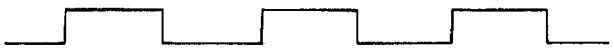
FIGS. 4A, 4B, 4C, 4D, 4E, 4F, 4G, 4H and 4I show waveforms of signals in an earthquake alarm system shown in FIG. 1 when the system operates.
Figure 4B:
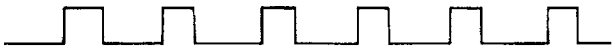
Figure 4C:
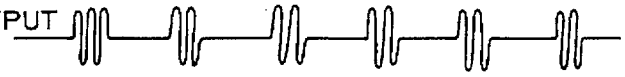
Figure 4D:
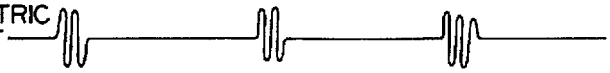
Figure 4E:
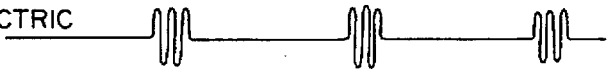

FIG. 4A shows the output (switching pulses) of the FF 8. This output is produced from output pulses shown in FIG. 4B of the MMV 7 and operates the switch circuit 10 as described above. The switch circuit 10 uses a terminal selected between the 'a' and 'b' terminals by the switching operation, and thus supplies the oscillation signal shown in FIG. 4C in the order of 100 Hz to the first and second piezoelectric speakers 3a and 3b alternately, and also to the abnormality detection circuit 6. The oscillation signals thus supplied to the first and second piezoelectric speakers 3a and 3b are shown in FIGS. 4D and 4E, respectively.

The oscillation signal supplied to the first piezoelectric speaker 3a causes the first piezoelectric speaker 3a to sound and the first acceleration sensor 2a detects vibration of the sound in the first piezoelectric speaker 3a. As a result, the first acceleration sensor 2a outputs a detection signal shown in FIG. 4F to the first comparator 4a. Similarly, the oscillation signal supplied to the second piezoelectric speaker 3b causes the second piezoelectric speaker 3b to sound and the second acceleration sensor 2b detects vibration of the sound in the second piezoelectric speaker 3b. As a result, the second acceleration sensor 2b outputs a detection signal shown in FIG. 4G to the second comparator 4b. These operations are alternately performed due to the switching operation by the switch circuit 10. A resulting operation performed by the abnormality detection circuit 6 was already described above with reference to FIGS. 2, 3A, 3B and 3C.

That is, if each of the first and second acceleration sensors 2a and 2b is normal, vibration of sound is positively detected in a respective one of the piezoelectric speakers 3a and 3b. As a result, the LED shown in FIG. 2 does not emit light. However, if, for example, the first acceleration sensor 2a malfunctions, the first comparator 4a does not output a predetermined signal and therefore the LED shown in FIG. 2 emits light. Thus, a malfunction in the first acceleration sensor 2a is indicated.

Figure 4F:
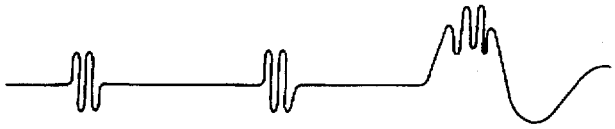
Figure 4G:
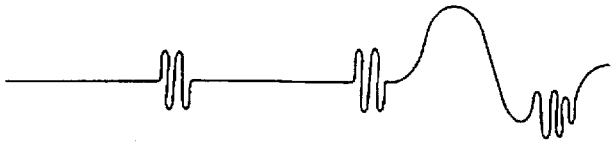
Figure 4H:
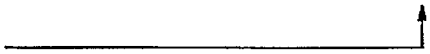
Figure 4I:
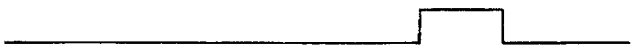

If each of the first and second acceleration sensors 2a and 2b is normal and an earthquake occurs as shown in FIG. 4H (an arrow in FIG. 4H indicates the earthquake occurrence), the first and second acceleration sensors 2a and 2b simultaneously detect the earthquake. Therefore, whether the first and second piezoelectric speakers 3a and 3b sound or do not sound, the first and second acceleration sensors 2a and 2b output the detection signals simultaneously. As a result, the outputs of the first and second acceleration sensors 2a and 2b are at the High level simultaneously as shown in FIGS. 4F and 4G. The outputs at the High level are supplied to the AND gate circuit 5 shown in FIG. 1 simultaneously from the first and second acceleration sensors 2a and 2b, and therefore the AND gate circuit 5 outputs the High level as shown in FIG. 4I.

Thus, by operating the set of first and second acceleration sensors 2a and 2b alternately using the switch circuit 10, it is possible to perform self diagnosis so as to detect a malfunction. Further, it is possible to surely detect shaking due to an earthquake or a similar emergency.

Figure 5:
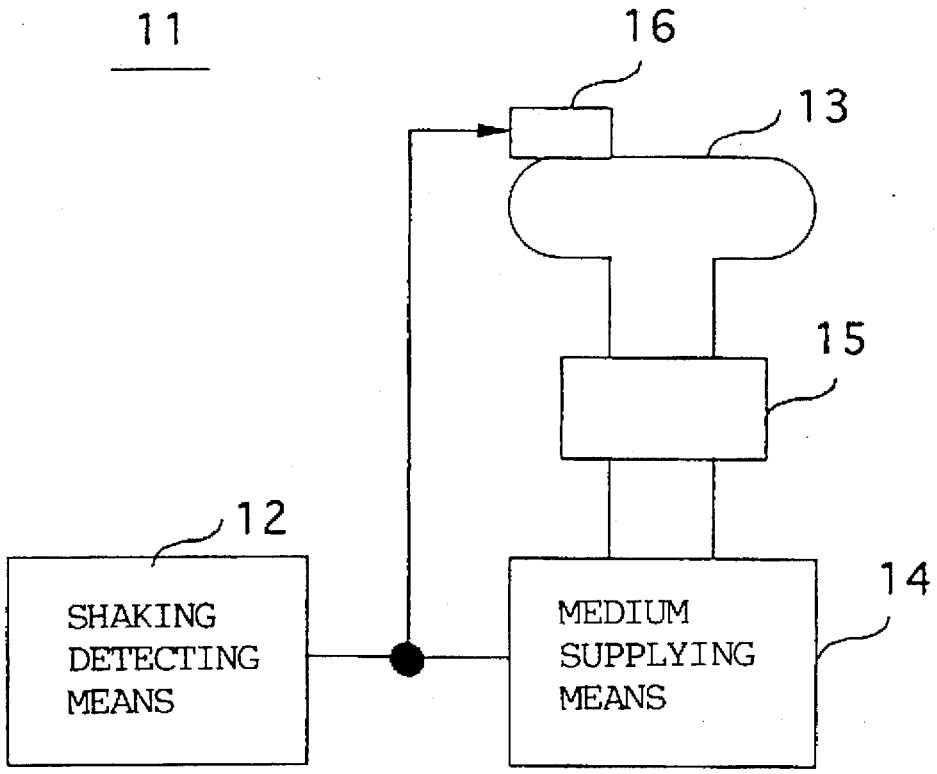
FIG. 5 shows a principle diagram of an application example of the first embodiment.

FIG. 5 shows a safeguard system 11 in the first embodiment of the present invention. In the system 11, shaking detection means 12 detects shaking of a predetermined intensity. Swelling means 13 receives a predetermined medium so as to swell to a predetermined size, block obstacles which are hurled due to the shaking, and thus ensures provision of a protective space. Medium supplying means 14 supplies the medium to the swelling means 13, which thus swells, in response to the shaking detection by the shaking detecting means 12.

In the system 11, backflow checking means (backflow checking valve) 15 is provided between the medium supplying means 14 and swelling means 13 and prevents the medium, to be supplied to the swelling means 13, from flowing backward. Further, alarming means 16 is provided and outputs a predetermined signal in response to the shaking detection by the shaking detecting means 12.

The shaking detecting means 12 is provided with the above-described earthquake detection system 1 and the earthquake detection signal from the AND gate circuit 5 of the earthquake detection system 1 is supplied to the medium supplying means 14 and alarming means 16.

Figure 6:
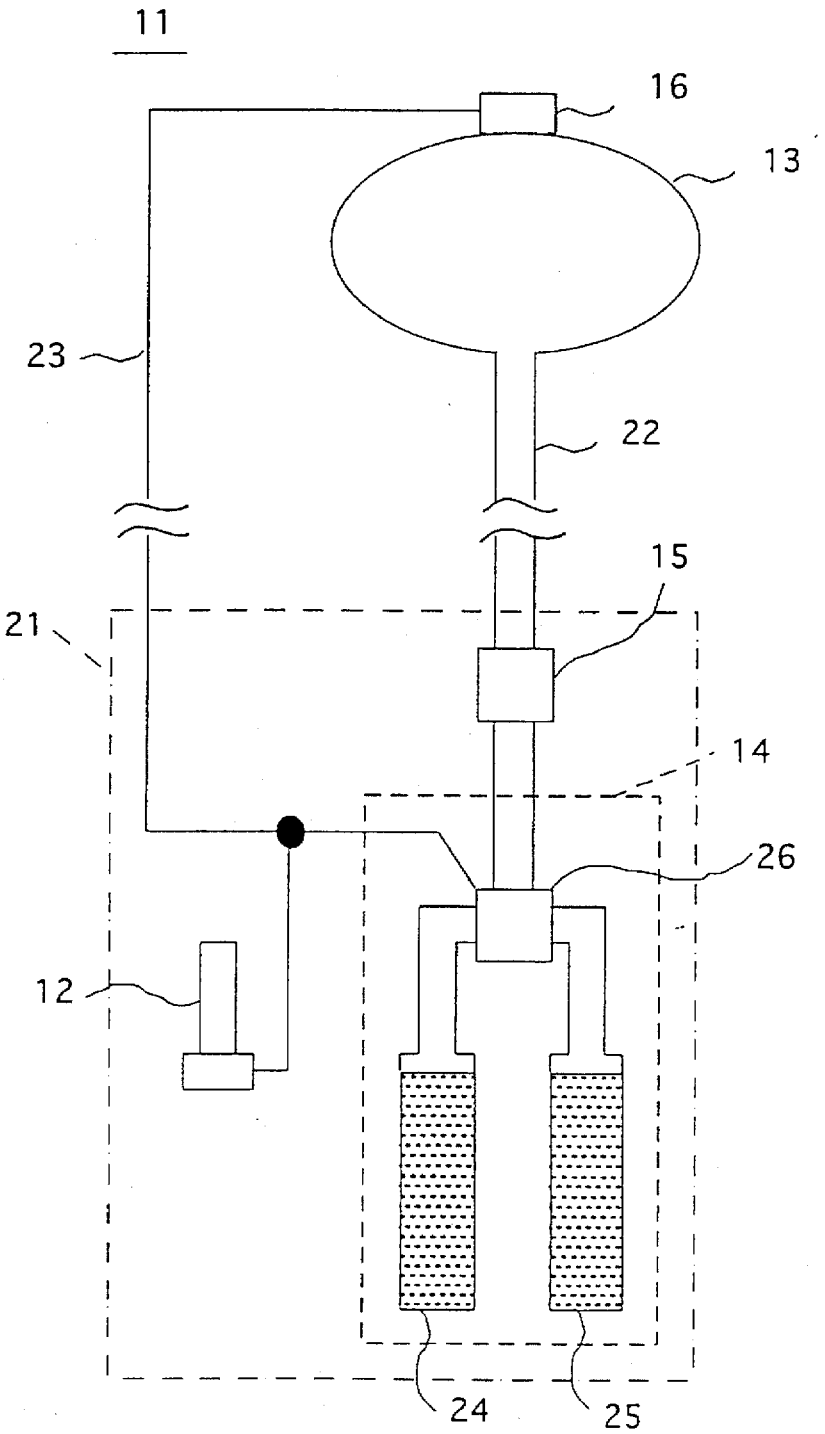
FIG. 6 shows a diagram of a specific example of the example shown in FIG. 5.

FIG. 6 shows a specific structure of the safeguard system 11. In the system 11, a control unit 21 communicates with an air mat 13 through a hose 22. Further, the air mat 13 has a signal generator 16, acting as the alarming means 16, mounted on the air mat 13. The signal generator 16 is electrically connected with the control unit 21 through a cord 23.

The air mat 13 swells to a predetermined size when a predetermined medium is put into the air mat 13. The predetermined size may be arbitrarily defined for a particular purpose. Specifically, as will be described later in description of an application example, the predetermined size is defined such that the air mat 13 of the predetermined size forms a protective space. The protective space is sufficiently wide that a human body can be in the space without a pressure being applied to the human body. Further, the air mat 13 has a strength such that the space is maintained even though a pressure by obstacles which will be described later is applied to the air mat 13. The air mat 13 is made of superior fire-proof and damage-proof materials, for example, made of a member including an appropriate amount of aramid fibers.

The signal generator 16 produces an alarm sound or generates an alarm signal of radio waves when the shaking detecting means including the above-described earthquake detecting system 1 detects a shaking. In the embodiment, the signal generator 16 is mounted on an outer surface of the air mat 13. However, it is also possible that the signal generator 16 is provided inside the air mat 13.

In the control unit 21, the above-described shaking detecting means 12 and a gas supply unit 14 act as the medium supplying means 14. It is also possible to use a general earthquake sensor as the shaking detecting means 12 instead of the above-described earthquake detection system 1.

There are various types of earthquake sensors such as an electromagnetic type, a piezoelectric type, a differential transformer type (acceleration type), a strain gage type and a capacity type. The electromagnetic type earthquake sensor with a built-in microswitch is economically advantageous. A sensitivity in such a type of earthquake sensor may be adjusted using a weight or the like. It is not necessary to set the sensitivity so sensitive that an earthquake sensor operates when an earthquake occurs with a seismic intensity by which no houses are destroyed and therefore operates frequently. For example, the sensitivity to be set may be such that the earthquake sensor operates when a ruinous earthquake occurs with an intensity such as an intensity of 5 or more on the Japanese seven-stage scale.

As the shaking detecting means, not only a sensor referred to as an earthquake sensor but also another sensor which can as a result detect an earthquake can be used. A sensor appropriate in consideration of required costs can be selected. A detection state (for example, a contact-closed state of the microswitch) of the shaking detecting means 12 is supplied to the signal generator 16 and to a mixer 26 which will be described later.

A chemical-reaction-type gas supply is used as the gas supply unit 14 in consideration of required costs. Therefore, a predetermined liquefied gas in a first container 24 and a different predetermined liquefied gas in a second container 25 are mixed and thus a chemical reaction occurs so that a volume of the mixed gas expands. A thus-expanded gas is then supplied at a predetermined pressure. The mixer 26 enters an open state when the shaking detecting means 12 detects shaking and thus a mixed gas is supplied to the air mat 13.

The gas supply by the gas supply unit 14, used when an earthquake occurs, may be performed instantaneously due to a shock applied, like a well-known air bag system used in an automobile. However, it is not necessary to perform the gas supply instantaneously. It is sufficient if the gas supply is performed within a time period (several seconds or several tens seconds) from a start of shaking of a predetermined intensity to a time houses begin to collapse. Therefore, it is not necessary to use the chemical-reaction-type gas supply. It is also possible to supply gas to the air mat 13 using a pump. It is also possible to use an explosion-type gas supply method with a gas-supply speed higher than those of the pump supply method and chemical-reaction-type gas supply method. It is also possible to use high-pressure liquefied gas containers or the like in the gas supply unit 14.

In this embodiment, a gas (which may be air) is used as the medium to fill the air mat 13 which thus swells. However, it is also possible to use another fluid (liquid, a granular material, a material with viscosity or the like) as the medium.

Gas supplied from the gas supply unit 14 is supplied to the air mat 13 via the backflow checking valve 15 and the hose 22 which is provided external to the control unit 21. The backflow checking valve 15 prevents gas once supplied to the air mat 13 from flowing backward, and thus maintains a swelled state of the air mat 13 for a long time. The backflow checking valve 15 is selected such that backward flowing is prevented even if a pressure by obstacles which are hurled due to destroying of houses or the like due to an earthquake is applied to the air mat 13. The obstacles are such as, for example, fallen chests of drawers and destroyed ceiling materials. The backflow checking valve 15 may operate in response to an applied pressure difference, a solenoid controlled valve which is electrically controlled, or the like. Selection may be made in consideration of required costs.

In the example shown in FIG. 6, a single the air mat 13 is provided to the control unit 21. However, it is also possible to provide a plurality of air mats 13 to the control unit 21 and the plurality of air mats 13 may be provided at places where it is necessary to provide the air mats 13.

In the safeguard system 11, when the shaking detecting means 12 detects an earthquake of a predetermined intensity, the mixer 26 in the gas supply unit 14 enters the open state and thus mixes the gases from the first and second containers 24 and 25. As a result, the mixed gases cause a chemical reaction and a volume of a resulting gas expands. The expanded gas is supplied to the air mat 13 via the backflow checking valve 15 and hose 22 at a predetermined pressure. As a result, as shown in FIG. 7B, the air mat 13 swells to a predetermined shape and thus produces the protective space. The air mat 13 is provided in a position such that a human body is positioned in the protective space. Then, if the above-mentioned obstacles are hurled toward the human body due to houses of the like being destroyed, the air mat 13 in the swelled state blocks the hurled obstacles and thus protects the human body in the protective space.

At this time, the signal generator 16 produces alarm in response to the earthquake detection by the shaking detecting means 12. Thereby, even if the human body is buried under rubble of destroyed houses, it is easy to find the human body and rescue the human body. Thus, the air mat 13 surely protects the human body against houses or the like being destroyed. Further, because the signal generator 16 enables an easy rescue of the human body, it is possible to prevent the human body from suffering a secondary disaster.

Figure 7A:
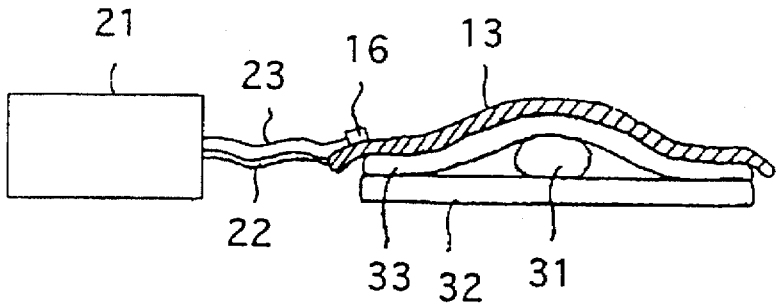
FIGS. 7A and 7B illustrate a first application example of the specific example shown in FIG. 6.
Figure 7B:
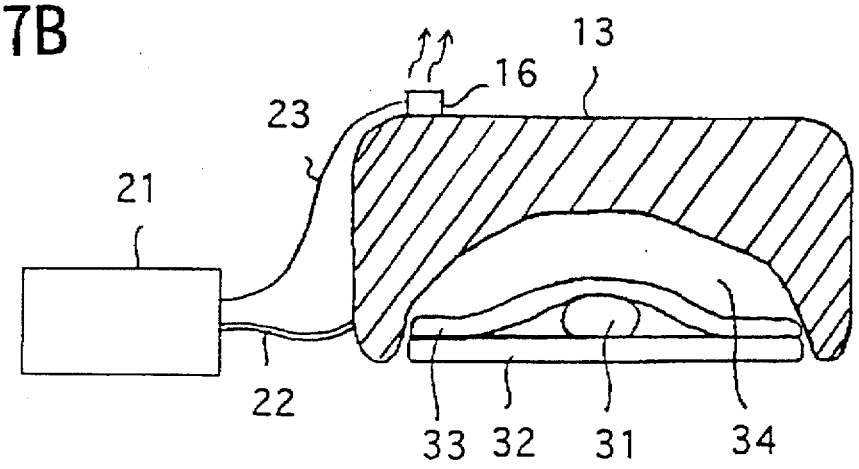

With reference to FIGS. 7A and 7B, the air mat 13 has a size similar to that of a quilt and transforms into a shape of an inverted concavity as shown in FIG. 7B when it swells. In FIG. 7A, a human body 31 is enveloped between a quilt 33 and a mattress 32 and a person of the human body 31 is sleeping there. The quilt 33 is covered with the air mat 13 in a non-swelled state.

When an earthquake occurs and is detected by the shaking detecting means in the control unit 21, the air mat 13 swells as shown in FIG. 7B. The air mat 13 has a shape in the swelled state shown in FIG. 7B such that the protective space 34 is produced on the human body 31. The air mat 13 in the swelled state blocks obstacles due to the earthquake and the human body 31 is protected in the protective space 34.

The signal generator 16 produces alarm simultaneously with the swelling of the air mat 13. Thereby, it is easy to locate the human body 31 and thus to rescue it.

Figure 8A:
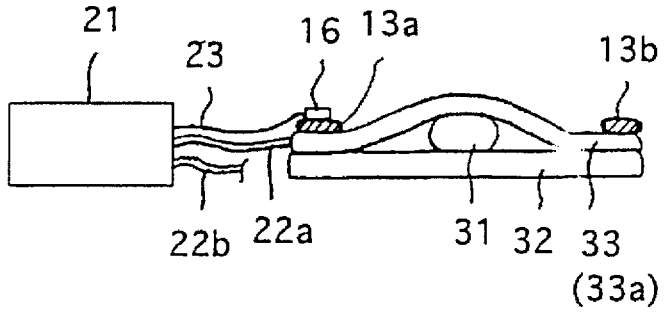
FIGS. 8A, 8B and 8C illustrate a second application example of the specific example shown in FIG. 6.
Figure 8B:
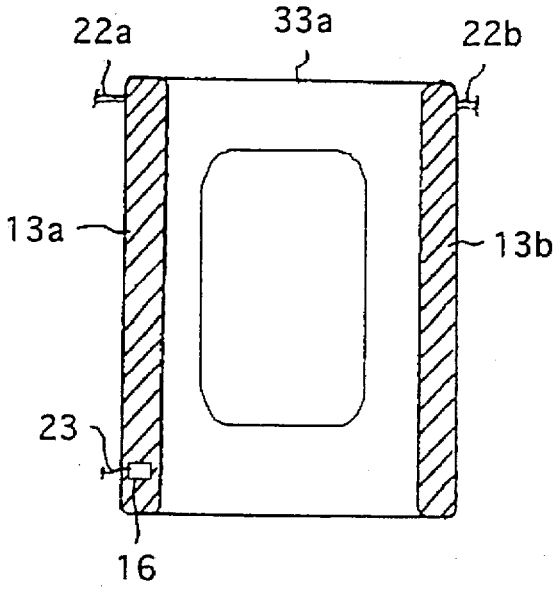

In an example shown in FIGS. 8A and 8B, two air mats **13*a* and 13*b* are provided instead of the air mat 13. The air mats 13*a* and 13*b* are mounted on two sides of a cover 33*a* of the quilt 33, the two sides being longer sides of the quilt 33. Each of the air mats 13*a* and 13*b* communicates with the control unit 21 via a respective one of hoses 22*a* and 22*b*. In this example, the air mat 13*a* is provided with the signal generator 16** mounted thereon.

Figure 8C:
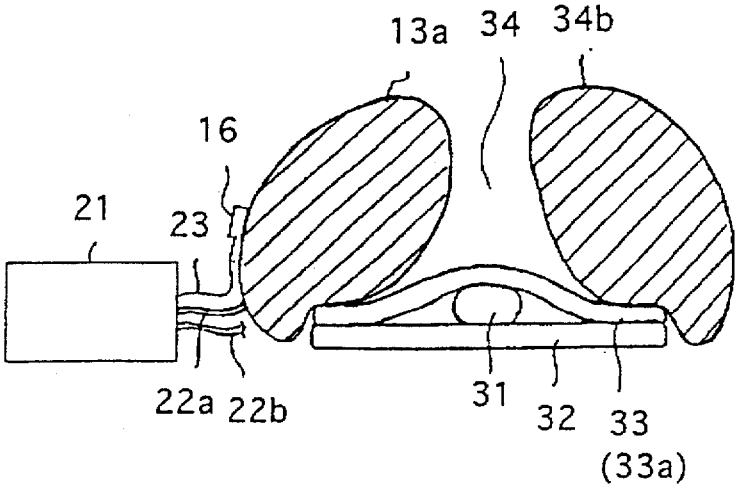

As shown in FIG. 8C, when the air mats 13*a* and 13*b* swell in an earthquake, the protective space 34 is provided above the human body 31. Similar to the above-described example, the air mats 13*a* and 13*b* in the swelled state block obstacles due to the earthquake and the human body 31 is protected in the protective space 34. Further, the signal generator 16 produces alarm.

Figure 9A:
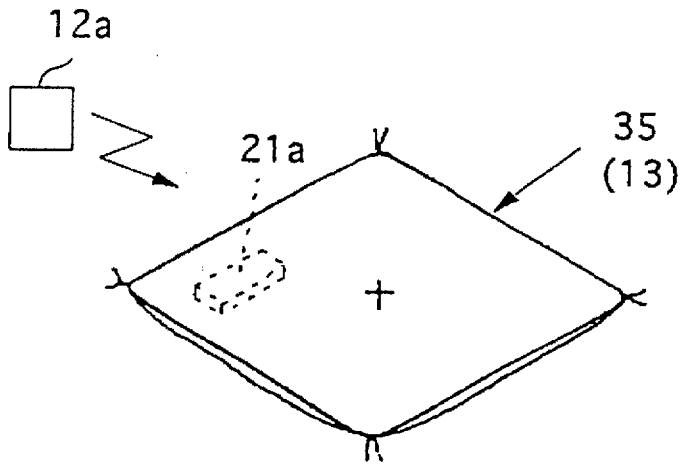
FIGS. 9A and 9B illustrate a third application example of the specific example shown in FIG. 6.

In an example shown in FIG. 9A, the air mat 13 in the non-swelled state is used as a cushion 35 as it is. The control unit 21*a* (having a function substantially the same as that of the control unit 21) including signal receiving means is incorporated inside the cushion 35 (air mat 13). In this example, shaking detecting means 12*a* provided with signal transmitting means using infrared rays or radio waves is not provided inside the control unit 21*a* but is mounted on a wall of a room of a house or the like. The shaking detecting means 12*a* transmits the earthquake detection signal in a wireless way.

Figure 9B:
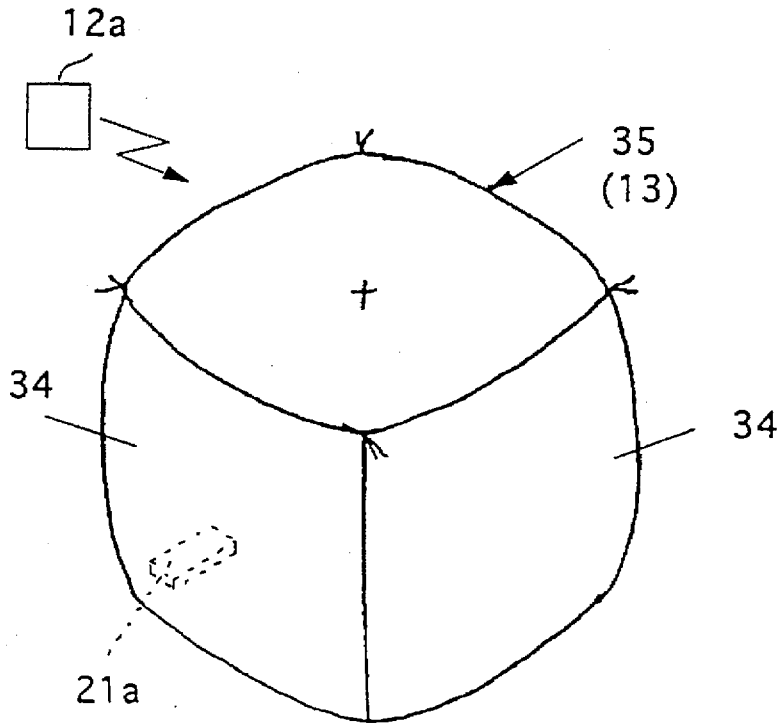

When the control unit 21*a* receives the earthquake detection signal from the earthquake sensor 12*a*, the cushion 35 (air mat 13) swells vertically as shown in FIG. 9B. If a single one of the cushion 35 (air mat 13) is used, a space surrounding a cube of the cushion 35 acts as the protective space. If a plurality of the cushions 35 are provided in a house room, spaces between the plurality of cushions 35 act as the protective space.

By providing the air mat 13 in a form of the cushion 35, it is possible to regularly use the air mat 13. As a result, the air mat 13 is likely to be nearby if an earthquake occurs.

In the example shown in FIG. 9A, the signal generator 16 is not provided. However, it is possible to provide the signal generator 16. If it is provided, the signal generator 16 has signal receiving means for receiving the earthquake detection signal from the shaking detecting means 12*a* in the wireless way.

As another application example, not shown in the figures, a predetermined number of the air mats 13 themselves may be provided at predetermined positions in a house room and may be embedded in a wall and floor of the house room at predetermined positions.

Thus, in the safeguard system according to the present invention, protection of a human body in an earthquake can be surely performed using the control unit 21 (21*a*) and air mat(s) 13 (13*a* and 13*b*). Because an arrangement of the safeguard system is simple, only low costs are required for the safeguard system. Thereby, the safeguard system can be widely used.

Figure 10:
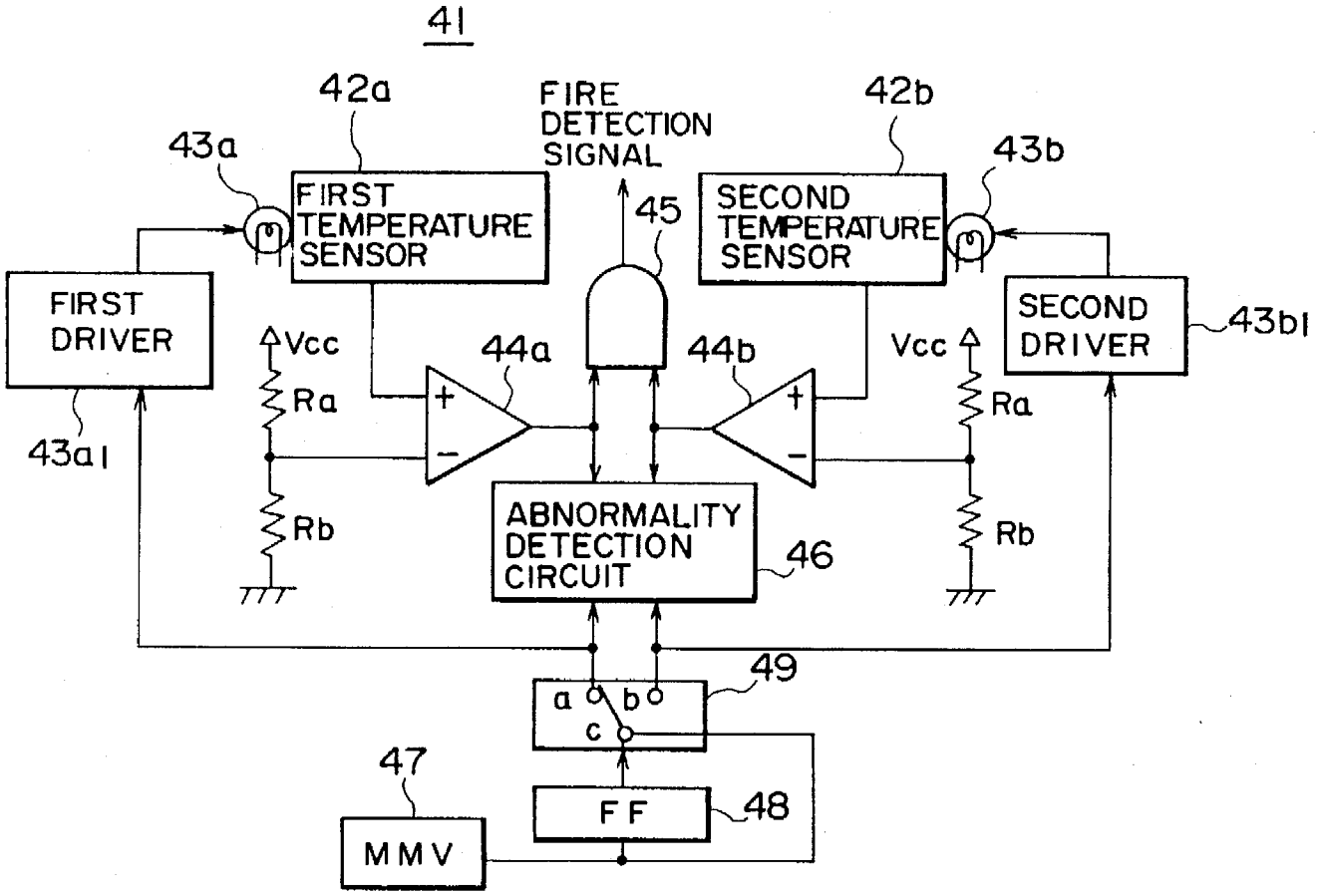
FIG. 10 shows a circuit diagram of a second embodiment of the present invention.

FIG. 10 shows a fire detecting system 41 in a second embodiment of an emergency detection sensor system according to the present invention. In the system 41, first and second temperature sensors 42*a* and 42*b* act as first and second detecting means and are provided in a detection area. The first and second temperature sensors 42*a* and 42*b* are provided with first and second heating units (for example, midget lamps) 43*a* and 43*b* which act as first and second pseudo-emergency generating means, respectively. Each of the first and second heating units 43*a* and 43*b* generates a pseudo-emergency in a respective one of the first and second temperature sensors 42*a* and 42*b* by heating the respective one and thus causes the respective one to detect the pseudo-emergency.

In the system 41, detection signals output by the first and second temperature sensors 42*a* and 42*b* are input to non-inverting input terminals of first and second comparators 44*a* and 44*b*, respectively. A reference voltage which is set from a power source Vcc via resistors Ra and Rb is input to an inverting terminal of each of the comparators 44*a* and 44*b*. An output of each of the first and second comparators 44*a* and 44*b* is supplied to an AND gate circuit 45 acting as emergency detection outputting means and to an abnormality detection circuit 46 acting as abnormality detecting means.

In the system 41, an MMV (Monostable Multi-Vibrator) 47 is provided and an output of the MMV 47 is supplied to a FF (Flip-Flop circuit) 48 and to a 'c' (common) terminal of a switch circuit 49. The output of the MMV 47 passing through an 'a' terminal and a 'b' terminal of the switch circuit 49 of the switch circuit 49 is then supplied, via first and second drivers (heating drivers) $43a_1$ and $43b_1$, to the first and second heating units 43*a*, 43*b* and to the abnormality detection circuit 46. The switch circuit 49 is operated by the output of the FF 48 and thus the 'a' and 'b' terminals are alternately connected with the 'c' terminal periodically. The MMV 47, FF 48 and switch circuit 49 act as driving means.

Figure 11A:
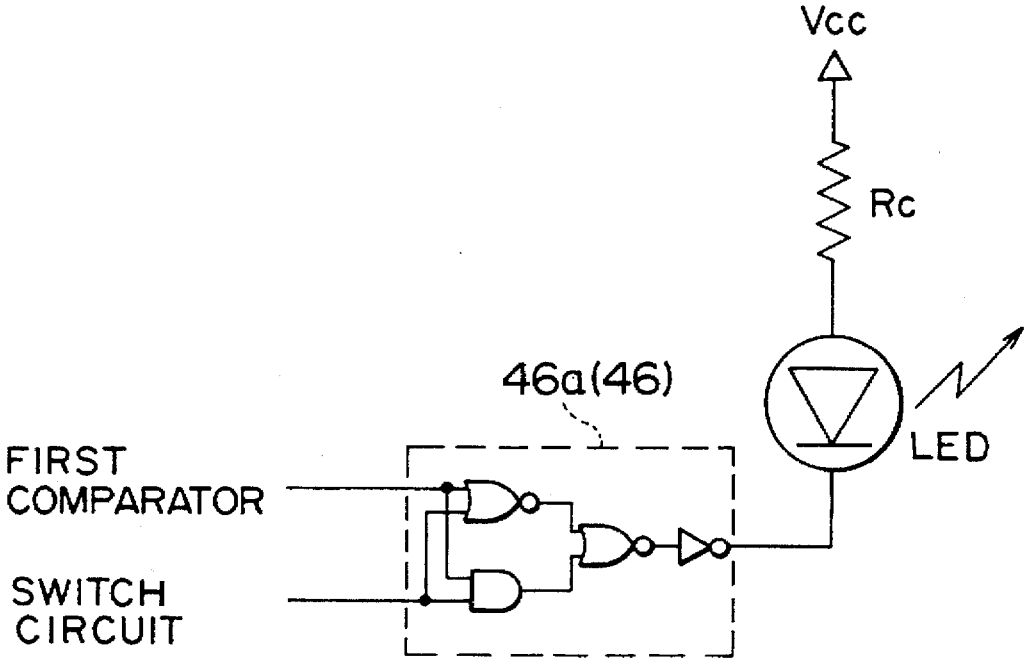
FIGS. 11A and 11B show circuit diagrams of an abnormality detection circuit and a heating driver in FIG. 10.

The abnormality detection circuit 46 includes, as shown in FIG. 11A, for example, an inverted exclusive-OR gate circuit 46*a* to which an output of the first comparator 44*a* is input and an output of the MMV 47 is input via the 'a' terminal of the switch circuit 49.

The inverted exclusive-OR gate circuit 46*a* supplies a Low-level output when levels of the two inputs are different from one another. That is, the inverted exclusive-OR gate circuit 46*a* supplies the Low-level output when a level of one of the two inputs is the High level and a level of the other one of the two inputs is a Low level. The inverted exclusive-OR gate circuit 46*a* supplies the High-level output when levels of both of the two inputs are the same level. That is, the inverted exclusive-OR gate circuit 46*a* supplies the High-level output when levels of both of the two inputs are the High level. The inverted exclusive-OR gate circuit 46*a* also supplies the High-level output when levels of both the two inputs are the Low level.

The inverted exclusive-OR gate circuit 46*a* has an open-collector logic circuit or another circuit having a function equivalent to the open-collector logic circuit, at an output portion thereof. Further, an LED is connected, in a manner matching a forward direction of the LED, between the power source Vcc via a resistor Rc and an output terminal of the inverted exclusive-OR gate circuit 46*a*. Thus, an anode of the LED is connected to the power source Vcc via the register Rc, and a cathode of the LED is connected to the output terminal of the inverted exclusive-OR gate circuit 46*a*. Further, a circuit identical to this circuit is provided for the other part including the second comparator 44*b*.

Figure 11B:
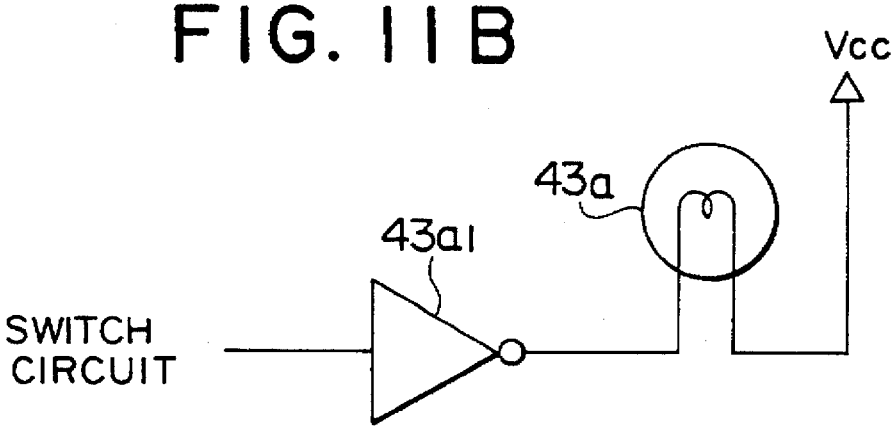

The first driver $43a_1$ includes, as shown in FIG. 11B, an inverter circuit $43a_1$. The inverter circuit $43a_1$ has an open-collector logic circuit or another circuit having a function equivalent to the open-collector logic circuit, at an output portion thereof. The output of the MMV 47 is input to the inverter circuit $43a_1$ and the heating unit 43*a* is connected between the power source Vcc and an output terminal of the inverter circuit $43a_1$. Further, a 10 circuit identical to this circuit is provided using the second driver $43b_1$.

Figure 12A:
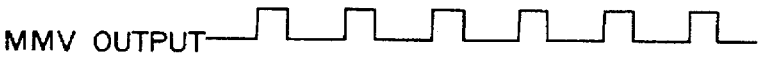
FIGS. 12A, 12B, 12C, 12D and 12E show waveforms of signals in a system shown in FIG. 10 when the system operates.
Figure 12B:
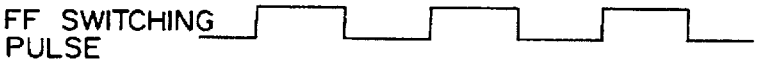

FIG. 12A shows pulses output by the MMV 47, which pulses are supplied to the FF 48 and the 'c' terminal of the switch circuit 49. By switching pulses output from the FF 48 shown in FIG. 12B, the switch circuit 49 is operated periodically as described above. Thereby, the output of the MMV 47 is alternately supplied to the first and second heating units 43*a* and 43*b* via the 'a' and 'b' terminals of the switch circuit 49, respectively, and thus alternately drives the first and second heating units 43a and 43b. As a result, the first and second heating units 43a and 43b, if they include the midget lamps, turn on alternately and thereby heat the first and second temperature sensors 42a and 42b alternately. Further, the output of the MMV 47 is supplied to the abnormality detection circuit 46 via the switch circuit 49.

Figure 12C:
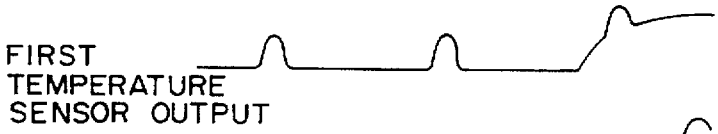
Figure 12D:
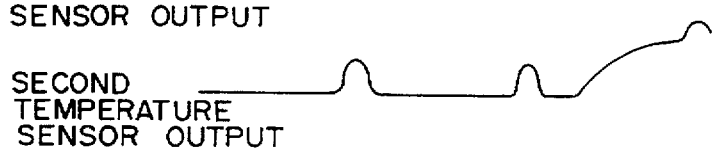

Due to the heating by the first and second heater units 43a and 43b, outputs of the first and second temperature sensors 42a and 42b increase and thus are at the High level alternately, as shown in FIGS. 12C and 12D. Each of the first and second comparators 44a and 44b outputs a detection signal to the abnormality detection circuit 46 when a level of a respective one of the outputs of the first and second temperature sensors 42a and 42b is equal to or more than a predetermined value. When the first and second temperature sensors 42a and 42b operate normally and thus perform temperature detection normally, the LED shown in FIG. 11A does not emit light.

This is because, when the switch circuit 49 connects the terminal 'a' with the terminal 'c', the High-level output of the MMV 47 is supplied to one input terminal of the inverted exclusive-OR gate circuit 46a in the abnormality detection circuit 46. Simultaneously, the same High-level output is supplied to the first driver $43a_1$ and thereby the first heating unit 43a heats the first temperature sensor 42a. As a result, the first temperature sensor 42a outputs the High-level output to the first comparator 44a which thus supplies the High-level output to the other input terminal of the inverted exclusive-OR gate circuit 46a. When the Low-level output of the MMV 47 is supplied to the one input terminal of the inverted exclusive-OR gate circuit 46a, the same Low-level output is supplied to the first driver $43a_1$ and thereby the first heating unit 43a does not heat the first temperature sensor 42a. As a result, the first temperature sensor 42a outputs the Low-level output to the first comparator 44a which thus supplies the Low-level output to the other input terminal of the inverted exclusive-OR gate circuit 46a.

Thus, when the High level is input to the one input terminal of the gate circuit 46a, the High level is input to the other input terminal of the gate circuit 46a. When the Low level is input to the one input terminal of the gate circuit 46a, the Low level is input to the other input terminal of the gate circuit 46a. As a result, the inverted exclusive-OR gate circuit 46a does not supply the Low-level output. Therefore, the LED shown in FIG. 11A does not emit light. A similar operation is performed by the other part including the second driver $43b_1$ when the switch circuit 49 connects the 'b' terminal with the 'c' terminal.

However, if, for example, the first temperature sensor 42a malfunctions, the first comparator 44a does not output the detection signal. As a result, the LED shown in FIG. 11A emits light and thus indicates the malfunction.

Figure 12E:
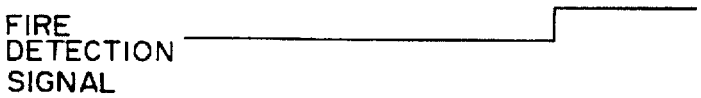

When the first and second sensors operate normally and a fire occurs, the first and second temperature sensors 42a and 42b simultaneously detect the fire. Therefore, whether the first and second heating units 43a and 43b heat or do not heat, the first and second temperature sensors 42a and 42b output the detection signals simultaneously. As a result, the outputs of the first and second temperature sensors 42a and 42b increase and thus are at the High level simultaneously as shown in FIGS. 12C and 12D. The outputs at the High level are supplied to the AND gate circuit 45 shown in FIG. 10 simultaneously from the first and second temperature sensors 42a and 42b, and therefore the AND gate circuit 45 outputs the High level as shown in FIG. 12E.

Thus, by operating the set of first and second temperature sensors 42a and 42b alternately using the switch circuit 49, it is possible to perform self diagnosis so as to detect a malfunction. Further, it is possible to surely detect an abnormal temperature due to a fire or a similar emergency.

Figure 13:
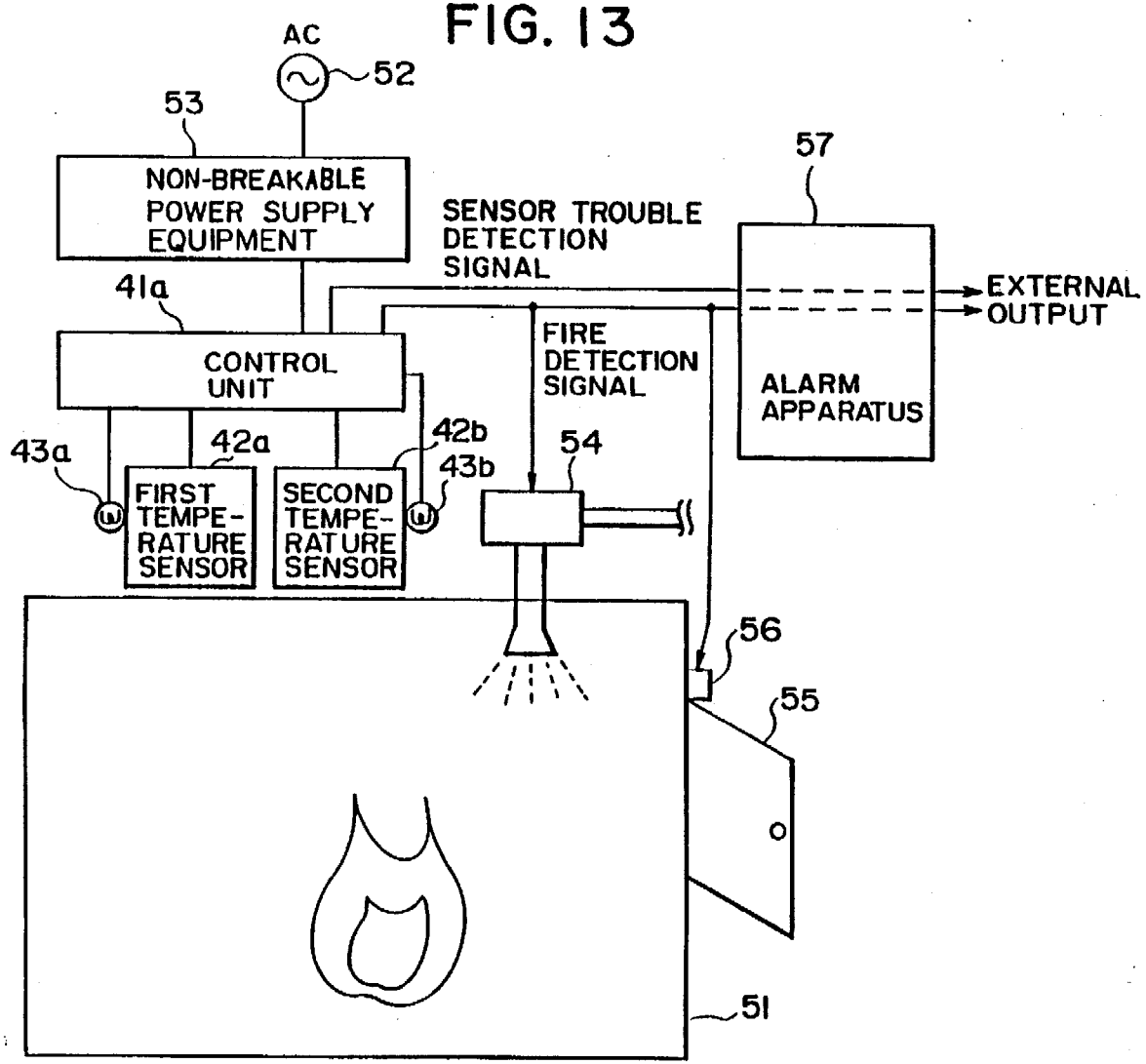
FIG. 13 illustrates an application example of the second embodiment.

In FIG. 13, the first and second temperature sensors which are provided with the first and second heating units 43a and 43b respectively are provided in a room 51 of the detection area. The first and second temperature sensors can be controlled by a control unit 41a (including the other parts shown in FIG. 10 but the LED in the above-mentioned abnormality detection circuit 46 being omitted therefrom). Non-breakable power supply equipment 53 which is connected with an alternating-current commercial power source AC 52 supplies power to the control unit 41a.

A water sprinkler 54 which operates in response to the fire detection signal from the control unit 41a is provided in the room 51. Further, a lock release mechanism 56 for releasing a lock of an emergency door 55 is provided in the room 51.

The control unit 41a supplies a predetermined sensor trouble detection signal and the fire detection signal to an alarm apparatus 57. The alarm apparatus 57 performs a predetermined alarming operation in response to reception of the sensor trouble detection signal and the fire detection signal, and also outputs an alarming signal externally. For example, a communications line is provided between the alarm apparatus and a security company and also between the alarm apparatus and a fire house, and thus enables communications therebetween.

Thereby, if one of the first and second temperature sensors 42a and 42b malfunctions, the control unit 41a reports the malfunction to the security company (which is provided with alarm indicating means), and maintenance is requested thereat. If a fire occurs, the control unit 41a causes the sprinkler 54 to operate and thus perform fire fighting. Further, at the same time, the control unit 41a causes the lock release mechanism 56 to operate and thus release a lock of the emergency door 55. Thereby, residents in the room 51 can escape from the room 51. Further, the control unit 41a reports the fire occurrence to the firehouse.

Thus, by regularly monitoring the first and second temperature sensors 42a and 42b so as to detect a malfunction therein, it is possible to keep the sensors 42a and 42b in a normal condition and thus surely detect an actual fire.

Further, the present invention is not limited to the above-described embodiments, and variations and modifications may be made without departing from the scope of the present invention.

What is claimed is:

1. An emergency detection sensor system comprising:

at least a set of first and second detecting means which detects an emergency;

first and second pseudo-emergency generating means which generate a pseudo-emergency for said first and second detecting means;

driving means which alternately drives said first and second pseudo-emergency generating means;

abnormality detecting means which detects operation of said first and second detecting means detecting the pseudo-emergency from said first and second pseudo-emergency generating means, said abnormality detecting means performing a predetermined indication when thus-detected operation is abnormal; and emergency detection outputting means which, in an emergency, outputs an emergency detection signal in response to reception of emergency detection signals from both said first and second detecting means.

2. The emergency detection sensor system according to claim 1, wherein:

the emergency comprises an earthquake;

said first and second detecting means comprise first and second acceleration sensors, respectively; and said first and second pseudo-emergency generating means comprise first and second piezoelectric speakers, respectively.

3. The emergency detection sensor system according to claim 1, wherein:

the emergency comprises a fire;

said first and second detecting means comprise first and second temperature sensors, respectively; and said first and second pseudo-emergency generating means comprise first and second heating means, respectively.

4. The emergency detection sensor system according to claim 1, wherein a predetermined indication is performed or predetermined emergency protecting means is driven by the emergency detection signal output by said emergency detection outputting means.

5. A safeguard system comprising:

shaking detecting means which detects shaking of a predetermined intensity;

swelling means which swells to a predetermined size in response to a predetermined medium put thereinto, thereby blocking hurled obstacles and producing a protective space;

medium supplying means which, in response to shaking detection by said shaking detecting means, supplies the predetermined medium to said swelling means and thus causes said swelling means to swell and wherein said shaking detecting means comprises:

at least a set of first and second detecting means which detects an emergency;

first and second pseudo-emergency generating means which generate a pseudo-emergency for said first and second detecting means;

driving means which alternately drives said first and second pseudo-emergency generating means;

abnormality detecting means which detects operation of said first and second detecting means detecting the pseudo-emergency from said first and second pseudo-emergency generating means, said abnormality detecting means performing a predetermined indication when thus-detected operation is abnormal; and emergency detection outputting means which, in an emergency, outputs an emergency detection signal in response to reception of emergency detection signals from both said first and second detecting means.

6. A safeguard system comprising:

shaking detecting means which detects shaking of a predetermined intensity;

swelling means which swells to a predetermined size in response to a predetermined medium put thereinto, thereby blocking hurled obstacles and producing a protective space;

medium supplying means which, in response to shaking detection by said shaking detecting means, supplies the predetermined medium to said swelling means and thus causes said swelling means to swell and further comprising backflow checking means which is provided between said medium supplying means and said swelling means, and prevents the predetermined medium, being supplied to said swelling means, from flowing backward.

7. A safeguard system comprising:

shaking detecting means which detects shaking of a predetermined intensity;

swelling means which swells to a predetermined size in response to a predetermined medium put thereinto, thereby blocking hurled obstacles and producing a protective space;

medium supplying means which, in response to shaking detection by said shaking detecting means, supplies the predetermined medium to said swelling means and thus causes said swelling means to swell and further comprising alarming means which produces alarm by outputting a predetermined signal in response to the shaking detection by said shaking detecting means.

* * * * *